United States Patent [19]

Kozuka et al.

[11] Patent Number: 4,677,409

[45] Date of Patent: Jun. 30, 1987

[54] ELECTROMAGNETIC SOLENOID WITH A REPLACEABLE FIXED IRON CORE

[75] Inventors: Hajime Kozuka, Okazaki; Tadayuki Hara; Isao Yamamoto, both of Himeji, all of Japan

[73] Assignee: Mitsubishi Denki Kabushiki Kaisha, Japan

[21] Appl. No.: 888,728

[22] Filed: Jul. 24, 1986

[30] Foreign Application Priority Data

Jul. 27, 1985 [JP] Japan ..... 60-115525[U]

[51] Int. Cl.[4] ..... H01F 7/08

[52] U.S. Cl. ..... 335/258; 335/281

[58] Field of Search ..... 335/251, 255, 258, 260, 335/274, 281

[56] References Cited

U.S. PATENT DOCUMENTS

| | | | |
|---|---|---|---|
| 3,188,427 | 6/1965 | Cooper et al. | 335/281 X |
| 3,249,823 | 5/1966 | Beardow | 335/258 |
| 3,314,032 | 4/1967 | Erden | 335/281 X |
| 3,461,412 | 8/1969 | Henderson | 335/281 |
| 3,805,203 | 4/1974 | Deckard | 335/258 X |

*Primary Examiner*—George Harris

*Attorney, Agent, or Firm*—Leydig, Voit & Mayer

[57] ABSTRACT

An electromagnetic solenoid for use with a fluid control valve is disclosed in which a fixed iron core and a casing for housing a solenoid coil can be fabricated separately from each other without difficulty, and in which the configuration and the clearance between the fixed iron core and a movable iron core or the length of the extension of the fixed iron core from an end wall of the casing can be readily changed in accordance with the desired magnetic attraction characteristics thereof as required. The cylindrical casing has an end wall formed at its one end and is open at its other end, the open end being closed by an end cap member to form a yoke for a magnetic circuit. The fixed iron core is adapted to be separably connected with the end wall of the casing. An output rod is disposed in the casing with its one end extending outwardly through the end wall of the casing, the output rod slidably extending through the fixed iron core and being supported at its opposite ends by the end wall of the casing and the end cap member through a pair of slide bearings for axial sliding movement. A movable iron core is received in the hollow of the solenoid coil and fixedly mounted on the output rod in a face-to-face relation with the fixed iron core. The end wall of the casing has an insertion bore formed therein, and the fixed iron core has its one end firmly fitted into the insertion bore.

4 Claims, 2 Drawing Figures

ELECTROMAGNETIC SOLENOID WITH A REPLACEABLE FIXED IRON CORE

BACKGROUND OF THE INVENTION

1. Field of the Invention

The present invention relates to an electromagnetic solenoid adapted to open and close a fluid control valve such as a flow-rate control valve, a pressure control valve, a changeover valve and the like.

2. Description of the Prior Art

FIG. 2 is a cross sectional view showing a conventional electromagnetic solenoid. In this FIG., reference numeral 1 designates a cylindrical casing having a fixed iron core 2 integrally formed with its end wall 1*a*, the casing 1 being closed at its open end opposite the end wall 1*a* by an end plate 3. The casing 1, the fixed iron core 2 and the end plate 3 jointly form a magnetic circuit. Housed in the casing 1 is a solenoid coil 4 which is wound around a bobbin or a winding frame 5 formed of synthetic resin. A movable iron core 6 is fixedly connected with an output rod 7 supported through a plain bearing 8 by the fixed iron core 2 for axial sliding movement relative thereto. Firmly fitted in the inner peripheral surface of the winding frame 5 is a sleeve 9 formed of a non-magnetic material for supporting the movable iron core 6 for axial sliding movement. The movable iron core 6 is biased toward the fixed iron core 2 under the action of a biasing spring 10. The electromagnetic solenoid constructed in the above manner is to be connected with a control valve 11 which is shown by the phantom line. In this case, though not shown in FIG. 2, the output rod 7 is biased in the leftward direction in FIG. 2 by a return spring (not shown) arranged in the control valve 11. The return spring in the control valve 11 is stronger than the spring 10 so that the movable iron core 6 is in the position shown in FIG. 2 when the solenoid coil 4 is not energized.

The above-mentioned conventional electromagnetic solenoid operates as follows. When the solenoid coil 4 is energized, the movable iron core 6 is caused to move by an electromagnetic force in the direction indicated by an arrow C in FIG. 2 toward the fixed iron core 2 against the biasing force of the return spring (not shown) arranged in the control valve 11.

With the above-described conventional electromagnetic solenoid, the casing and the fixed iron core 2 integrally formed therewith are difficult to fabricate and/or machine. Furthermore, the configuration and the length of extension of the fixed iron core 2 from the casing end wall 1*a* and hence the required operating characteristics of the solenoid can not be changed after fabrication thereof.

SUMMARY OF THE INVENTION

The present invention is intended to obviate the above-mentioned problems of the prior art, and has for its object the provision of an electromagnetic solenoid in which the casing can be fabricated without difficulty, and in which the configuration and the length of the extension of the fixed iron core can be readily changed in accordance with the magnetic attraction characteristics as required.

In order to achieve the above object, according to one aspect of the present invention, there is provided an electromagnetic solenoid comprising: a housing made of a magnetic material; a hollow cylindrical electromagnetic coil disposed within the housing; a movable iron core disposed in the electromagnetic coil and slidable between at least two axially spaced positions; an output rod extending from the movable iron core and projecting outwardly from the housing for transmitting the movement of the movable iron core to the exterior of the housing; and a replaceable fixed iron core detachably attached to the housing for defining, in cooperation with the housing and the movable iron core, a magnetic circuit through which a magnetic flux generated by the electromagnetic coil can pass for electromagnetically driving the movable iron core between the above-mentioned positions, the fixed iron core limiting the movement of the movable iron core beyond one of the positions, whereby the magnetic characteristics of the magnetic circuit and the one of positions at the which movable iron core stops are changeable by replacing the fixed iron core with a different fixed iron core.

According to another aspect of the present invention, there is provided an electromagnetic solenoid which comprises: a cylindrical casing having an end wall formed at its one end and which is open at its other end; an end cap member detachably secured to the open end of the casing for closing thereof and adapted to cooperate with the casing to form a yoke for a magnetic circuit; a solenoid coil accommodated in the casing; a replaceable fixed iron core separably connected with the end wall of the casing; an output rod disposed in the casing with its one end extending outwardly through the end wall of the casing, the output rod slidably extending through the fixed iron core so as to be axially slidable therethrough; and a movable iron core received in the hollow of the solenoid coil and fixedly mounted on the output rod in a face-to-face relation with the fixed iron core.

According to an embodiment of the present invention, the end wall of the casing has an insertion bore formed therein, and the fixed iron core has its one end firmly fitted into the insertion bore.

Preferably, the fixed iron core is of a cylindrical configuration and is formed at its one end with an axially extending annular extension into which the adjacent end of the movable iron core is disposed.

The output rod may include a small-diameter portion and a large-diameter portion with a stepped shoulder defined therebetween, the movable iron core being slidably fitted over the small-diameter portion and biased by a biasing means against the stepped shoulder on the output rod.

One of the slide bearings disposed in the end cap member may comprise a slide ball bearing, and the other of the slide bearings disposed in the casing end wall may comprise a plain bearing.

The above and other objects, features and advantages of the present invention will become apparent from the following detailed description of a presently preferred embodiment of the invention when taken in conjunction with the accompanying drawings.

DESCRIPTION OF THE PREFERRED EMBODIMENT

Figure 1:
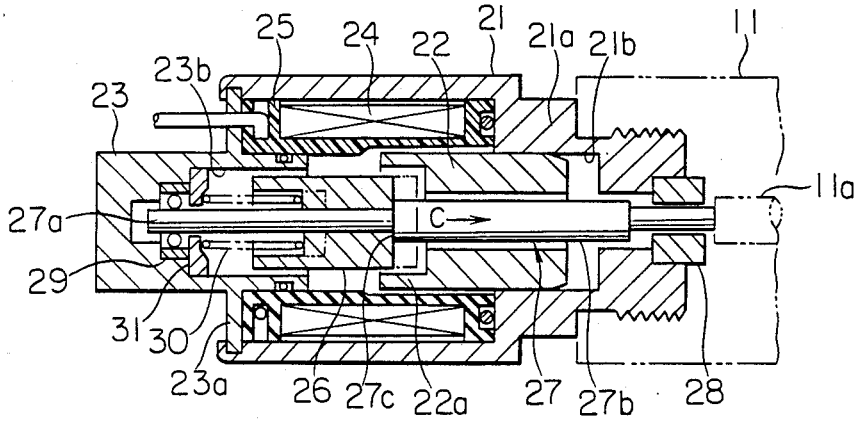
FIG. 1 is a cross sectional view showing an electromagnetic solenoid in accordance with the present invention.
Figure 2:
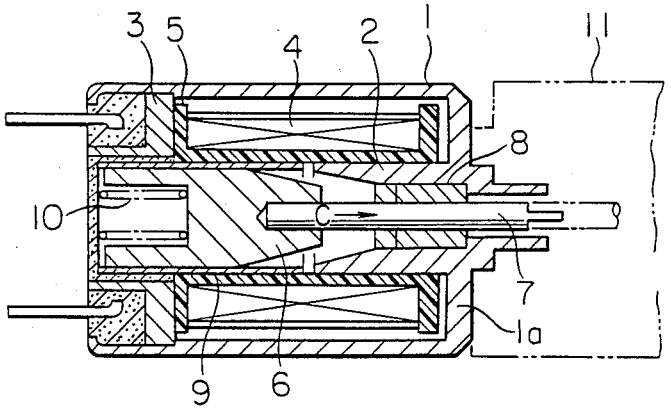
FIG. 2 PRIOR ART
FIG. 2 is a cross sectional view showing a conventional electromagnetic solenoid.

In FIG. 1, there is shown an electromagnetic solenoid constructed in accordance with the present invention. The electromagnetic solenoid includes a casing 21 which is formed of a magnetic material and which constitutes a yoke. The casing 21 has an end wall 21*a* at its one end and is open at its other end, the open end of the casing 21 being closed by a cylindrical end cap member 23 formed of a magnetic material. The end cap member 23 has a radially outwardly projected annular flange 23*a* which is detachably secured to the open end of the casing 21, the casing 21 and the end member 23 being adapted to form a magnetic circuit. Accommodated in the casing 21 is a fixed iron core 22 of a cylindrical configuration which is formed of a magnetic material and which is integrally formed at its one end with an axially extending annular extension 22*a*. The fixed iron core 22 constitutes a part of the magnetic circuit. The fixed iron core 22 is slightly tapered at its other end and is press fitted into a cylindrical insertion bore 21*b* formed in the end wall 21*a* of the casing 21 so that the fixed iron core 22 is fixed to the casing 21 with its one end axially projecting a certain distance from the inner surface of the casing end wall 21*a*. Housed in the casing 21 is a solenoid coil 24 which is wound around a winding frame or a bobbin 25 formed of synthetic resin, the bobbin being disposed so as to surround both a portion of the outer peripheral surface of the end cap member 23 and a portion of the outer peripheral surface of the fixed iron core 22.

An output rod 27 formed of a non-magnetic material is disposed axially in the casing 21 and extends at its one end outwardly through the casing end wall 21*a*. The output rod 27 has a small-diameter portion 27*a* and a large-diameter portion 27*b* and is axially slidably supported at its one end by a slide bearing 28 in the form of a plain bearing disposed in the casing end wall 21*a* and at its other end by a slide bearing 29 in the form of a slide ball bearing disposed in the end cap member 23.

Slidably mounted on the small-diameter portion 27*a* of the output rod 27 is a cylindrical-shaped movable iron core 26 which has one end disposed in the axial annular extension 22*a* of the fixed iron core 22 in a face-to-face relation with the adjacent end surface of the fixed iron core 22. The movable iron core 26 is biased against the stepped shoulder 27*c* on the output rod 27 under the action of a biasing means 30 in the form of a coiled compression spring which is disposed under compression between the other end of the movable iron core 26 and a spring seat 31 of non-magnetic material fixedly mounted on the inner peripheral surface of an axial bore 23*b* in the end cap member 23.

The electromagnetic solenoid as constructed in the above-described manner is to be connected with a control valve device 11 with the outwardly projected end of the output rod 27 being coupled to an appropriate member 11*a* as illustrated in FIG. 1. In this connection, it is to be noted that the output rod 27 is urged in the leftward direction in FIG. 1 under the action of a return spring (not shown) disposed in the control valve device 11.

In operation, when the solenoid coil 24 is energized, the movable iron core 26 is magnetically attracted toward the fixed iron core 22 so that the output rod 27 is thereby caused to move in the rightward direction indicated by an arrow C against the return spring (not shown) disposed in the control valve device 11 for opening or closing of the control valve device.

It will be appreciated that the fixed iron core 22 is fabricated separately from the casing 21 and hence formed, without difficulty, in an appropriate configuration so as to meet magnetic attraction characteristics as required. The fixed iron core 22 thus formed has its one end then press fitted into the insertion bore 21*b* in the casing end wall 21*a* so that the other end of the fixed iron core 22 facing the movable iron core 26 projects axially inward a certain desired distance from the inner surface of the end wall 21*a*.

The electromagnetic solenoid of the present invention as constructed above may also be used for controlling the opening and closing operation of a flow control valve, a pressure control valve, a changeover valve or other like fluid control valves.

As described in the foregoing, the present invention provides the following advantages. Due to a construction where the fixed iron core, fabricated separately from the casing, is adapted to be detachably connected with the casing end wall, the configuration and the length of the fixed iron core inwardly projected from the inner surface of the casing end wall can be precisely determined without difficulty in accordance with desired magnetic attraction characteristics as required. Thus, such magnetic attraction characteristics can be obtained with extreme ease merely by employing an appropriate shape or type of fixed iron core with the use of a single kind of casing.

What is claimed is:

1. An electromagnetic solenoid comprising:

a housing made of a magnetic material;

a hollow cylindrical electromagnetic coil disposed within said housing;

a movable iron core disposed in said electromagnetic coil and slidable between at least two axially spaced positions;

an output rod extending from said movable iron core and projecting outwardly from said housing for transmitting the movement of said movable iron core to the exterior of said housing; and a replaceable fixed iron core detachably attached to said housing for defining, in cooperation with said housing and said movable iron core, a magnetic circuit through which a magnetic flux generated by said electromagnetic coil can pass for electromagnetically driving said movable iron core between said positions, said fixed iron core limiting the movement of said movable iron core beyond one of said positions, whereby the magnetic characteristics of said magnetic circuit and one of said positions at which said movable iron core stops are changeable by replacing said fixed iron core with a different fixed iron core.

2. An electromagnetic solenoid comprising:

a cylindrical casing having an end wall formed at its one end which is open at its other end;

an end cap member detachably secured to the open end of said casing for closing thereof and adapted to cooperate with said casing to form a yoke for a magnetic circuit;

a solenoid coil accommodated in said casing;

a replaceable fixed iron core separably connected with the end wall of said casing;

an output rod disposed in said casing with its one end extending outwardly through the end wall of said casing, said output rod extending through said fixed iron core and being supported by said casing so as to be axially slidable therethrough; and a movable iron core received in the hollow of said solenoid coil and fixedly mounted on said output rod in a face-to-face relation with said fixed iron core.

3. An electromagnetic solenoid as claimed in claim 2, wherein the end wall of said casing has an insertion bore formed therein, and wherein said fixed iron core has its one end firmly fitted into said insertion bore.

4. An electromagnetic solenoid as claimed in claim 3, wherein said fixed iron core is of a cylindrical configuration and is formed at its one end with an axially extending annular extension into which the adjacent end of said movable iron core is disposed.

* * * * *